US005467544A

United States Patent [19]

Treuberg

[11] Patent Number: 5,467,544

[45] Date of Patent: Nov. 21, 1995

[54] ELECTRIC SIGN ADVERTISING ELEMENT

[76] Inventor: Heinz D. Treuberg, P.O. Box 271482, Tampa, Fla. 33688

[21] Appl. No.: 395,209

[22] Filed: Feb. 27, 1995

Related U.S. Application Data

[63] Continuation of Ser. No. 264,252, Jun. 22, 1994, abandoned, which is a continuation of Ser. No. 33,780, Mar. 17, 1993, abandoned, which is a continuation of Ser. No. 946,066, Sep. 18, 1992, abandoned.

[51] Int. Cl.[6] ..... G09F 13/04

[52] U.S. Cl. ..... 40/564; 40/582

[58] Field of Search ..... 40/564, 578, 582, 40/152.2, 541; 362/297, 298, 812

[56] References Cited

U.S. PATENT DOCUMENTS 1,279,096 9/1918 Fitzgerald ..... 362/298
1,998,967 4/1935 Raynolds ..... 362/298 X
4,307,528 12/1981 Dewees et al. ..... 40/582 X
5,152,060 10/1992 Schubert et al. ..... 29/890.039

*Primary Examiner*—Kenneth J. Dorner
*Assistant Examiner*—Joanne Silbermann
*Attorney, Agent, or Firm*—Foley & Lardner

[57] ABSTRACT

An electric sign advertising element with at least one light source and a cover hood, which is at least partially light transmissive and envelops the light source(s) and which has an at least partially light transmissive outer segment, which is bent off toward the rear and which is bordered by a reflector segment, whose inside reflects light at least partially, extends from its rear end to the front, is bent off outwardly and which reflects light coming through the outer segment, wherein the reflector segment protrudes toward the front beyond the outer segment by at least one-third its height, at least by about 1".

31 Claims, 3 Drawing Sheets

ELECTRIC SIGN ADVERTISING ELEMENT

This application is a continuation of application Ser. No. 08/264,252, filed Jun. 22, 1994, now abandoned, which in turn is a continuation of Ser. No. 08/033,780, filed Mar. 17, 1993, now abandoned, which in turn is a continuation of Ser. No. 07/946,066, filed Sep. 18, 1992, now abandoned.

BACKGROUND OF THE INVENTION

This invention relates to an electric sign advertising element with at least one light source and a cover hood. The advertising element is generally made of plastic and is at least partially light transmissive, enveloping the light source(s). It is to be attached to an attachment surface or generally to an installation carrier, which is in turn to be attached to an attachment surface. The carrier generally carries the light source(s) and other installation elements and which has an at least partially light transmissive, frame-like outer segment which is bent off toward the rear and which is bordered by a reflector segment, whose inside reflects light at least partially, extends from its rear end to the front, is bent off outwardly and which reflects light coming through the outer segment from the light source.

In electric sign advertising technology it is desirable to have available electric sign advertising elements that allow the desired advertising effect to be obtained, if possible, not only at night (thus with light supply turned on) but also during the day. To this end, it is necessary in any event to attract, first of all, the attention of the potential viewers, so that they will also look at the corresponding advertisement. In addition, however, it is also extremely important not only to adapt the advertisement applied on the electric sign advertising element itself (be it now pictures or type face), which is printed generally with screen printing or the like on the front side of the cover hood of an electric sign advertising element, to the advertised product or to the advertised service, but also those elements of an electric sign advertising element, which are to attract the attention of the passersby—with or without a concrete reference to the advertised matter. In so doing, the advertising elements which are suitable, e.g., for a night bar, are routinely other than advertising elements, which are to advertise a first rate product. Whereas for the former conspicuous colors are generally suitable, they are less suitable for more serious services and high quality products. They do induce even there the desired attention-getting effect, but produce readily the impression of a "thriller" advertisement and lead then to negative inferences about the quality of the advertised matter. Rather more subdued colors and in particular a metallic lustre effect have proven to be especially suitable for advertising first rate products or services. Breweries, for example, have already made use of this knowledge in designing beer bottles, which are provided in part with silver or gold colored wrappings (made of metallic foil or metallized paper) and with corresponding lettering, whereas this knowledge has gained only limited admission to date into the electric sign advertising technology.

This may lie in the fact that an electric sign advertising element of suitable design may render the desired effect during the day, but not at night or vice versa. It may also lie in the fact that the advertising effect of the outer region of the electric sign advertising elements that forms, so to speak, a frame has not been given much attention to date—presumably for the above reasons, even though the outer region, which envelops the actual advertisement like a frame is suitable not only in particular to attracting with a suitable design the attention of a potential view but also the statement to be communicated with the actual advertisement can be backed up in a highly effective manner.

To be sure, besides electric sign advertising elements, provided with a striking colored outer region, electric sign advertising elements also already exist that exhibit a light reflecting reflector segment enveloping their outer edge; yet the effect of such electric sign advertising elements was unsatisfactory especially at night in particular because the light emitted by the light source(s) of the electric sign advertising element, issuing through the outer segment of its cover hood and reflected by the reflector segment to the front, have merely a bright or glaring effect on the viewer. With a silver colored layer on the reflector strip the light reflected to the front seems to be white to the viewer and with a gold colored coating light yellow, without producing the desired precious metal effect.

SUMMARY OF THE INVENTION

The present invention is based on the problem of providing an electric sign advertising element whose advertising effectiveness is improved in particular by a special design of its outer region forming, so to speak, a frame, whereby both during the day and at night the advertising effect of glowing gold, silver or the like that is extremely valuable especially for first rate products and services can be achieved in an impressive manner.

According to the invention, this problem is solved by designing the reflector segment so as to reflect light on its inside and to reflect light which is radiated by the light source(s) and falls through the outer edge. The reflector segment protrudes toward the front beyond the outer segment, and in particular expediently by at least about 1". Namely it has been shown surprisingly that this projection produces a dark region that becomes lighter from the front to the rear and brings about that the targeted precious metal effect is produced, for example, when a reflecting segment is coated with a gold or silver foil on the inside and the negative phenomena of merely glaring brightness are totally eliminated, Rather owing to the projection of the reflecting segment according to the invention beyond the outer segment the result is a surprising warm and "satiating" effect, as desired for the advertising effect under discussion here, In so doing, it has been demonstrated that the sought for effect can be obtained in particular with larger electric sign advertising elements if the reflector segment projects by a third of its height over the outer segment.

Even though the targeted effect can be achieved to a specific degree owing to the provision of a front dark region, even if the inside of the reflector segment is designed so as not to reflect light over its entire height, it has been proven to be highly expedient if the inside of the reflector segment is also designed so as to reflect light in its segment protruding towards the front beyond the outer segment, especially since this embodiment produces a continuous dark-light transition that is optically highly attractive. Nevertheless, it can be expedient if the front outer section of the inside of the reflector segment is designed as a (generally relatively narrow) bright (e.g. white) strip. The consequence is that the shadow effect produced by the protrusion of the reflector segment is delimited from the environment in a manner that is still recognizable, so that the outer edge of such a designed electric sign advertising element is not lost in the dark.

Instead of being designed continuously in gold or silver color, the inside of the reflector segment can be coated at least section by section with a hologram foil, in particular with a hologram foil which in turn reflects precious metal colored light. The result of such a design is an especially charming and attention catching effect, whereby even with such a design the shadow produced by the protrusion of the reflector segment accentuates the hologram in an especially impressive manner.

An especially appealing design of the outer region of an electric sign advertising element can be obtained when the outside of the coating on the reflector segment is designed as a reflecting surface, and when in addition at least one section of the side of the outer segment that faces the reflector segment is provided with a reflecting coating. Since in this case both coatings are mutually reflected in each other, the result is an "infinity effect", i.e. the one coating is reflected repeatedly in the other coating and vice versa.

It is not at all necessary that the outer segment be reflected over its entire height. Rather it suffices if the central section of the side of the outer segment facing the reflector segment is reflected, so that light reflected from the light source(s) at the upper and lower end of the outer segment can exit through these sections of the outer segment and can fall on the reflecting coating of the reflector segment.

As an alternative or addition, the reflecting coating of the outer segment can be provided with at least one, preferably a plurality of light transmissive points, through which the light can exit, whereby these light transmissive points can be arranged in a specific pattern, but also, for example, as a flourish or as a picture that is then reflected by the reflecting coating of the reflector segment.

If the coatings of the reflector segment and the outer segment are designed identically (thus e.g. both as gold or silver coating) the result is an especially satisfying precious metal effect, yet the two coatings can also be designed optionally differently, whereby, for example, one coating is designed as a gold colored coating and the other coating as a silver colored coating.

Another highly advertising effective effect can be obtained with an embodiment of the electric sign advertising element, where light emitted from the/a light source is guided through a variety of glass fiber cables to the outer segment, where the ends of the glass fiber cable are led preferably through the outer segment, so that they form there bright (optionally colored) points, which are reflected then in the coating of the reflector segment.

In so doing, a device can be arranged between the light source and the light inlet of the glass fiber cable; by means of this device the light emitted by the light source is to be changed periodically with filters, which are mounted on a rotary disk or the like, which can be rotated by a motor.

In another embodiment of the present invention at least one section of the side of the outer segment that faces the reflector segment or one section of the reflector segment itself can be coated with a light storage foil, which still emits light for a long time after the light source(s) has been mined off. In so doing, in this embodiment the light storage foil can also be provided with passive-storing sections (e.g. imprints), which reproduce a pattern, a flourish or the like.

According to another embodiment of the present invention, at least one section of the side of the outer segment that faces the reflector segment or one section of the reflector segment itself can be provided with a so called engraved foil, that exhibits generally a plurality of engraved lines, whose appearance changes with the viewer's relative position to the electric sign advertising element and increases in this manner the attention of a potential viewer.

According to another embodiment of the present invention, the reflector segment can be designed as at least two steps, where one section lying further to the front is offset outwardly relative to another section of the reflecting segment that lies further to the rear. Such a jump in the reflecting segment produces (at least) one additional shadow region, which produces in an extremely effective manner, generally speaking, the impression of a multipart gold frame or the like.

The outer segment of the cover hood extends preferably substantially parallel to the vertical axis of symmetry (optionally also slightly toward the center) and not outwardly from the front to the rear, in order to draw the view of the viewer largely away from it and to allow in essence only the optical effect produced by the reflecting segment to become effective, in particular when the outer segment is made transparent, as is preferably anticipated, whereby it has also been proven to be expedient if the outer segment is fluted or screened, since in this case the light sources, disposed in its interior, and other installation elements are highly distorted and the reflecting segment can unfold an optimal effect.

BRIEF DESCRIPTION OF THE DRAWINGS

The invention is explained in the following with the aid of embodiments with reference to the drawings.

DESCRIPTION OF THE PREFERRED EMBODIMENTS

Figure 1:
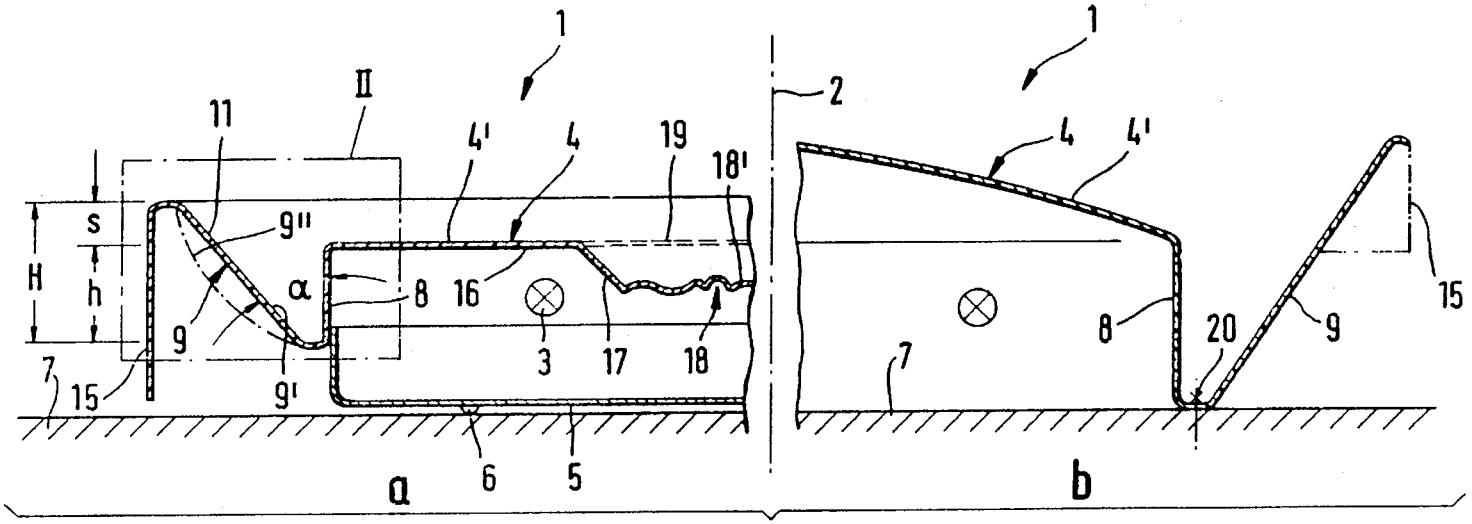
FIG. 1 is partly schematic cross-sectional view of an electric sign advertising a element, and in particular the left part (a) of a first embodiment and right part (b) of a second embodiment.

The left part (a) of FIG. 1 is a sectional view of an electric sign advertising element, all of which is denoted as 1 and whose part (not illustrated) lying to the right to the axis of symmetry 2 is designed symmetrically as a minor image.

The electric sign advertising element 1 has two light sources 3, of which only the one is shown in FIG. 1*a*, and a plastic cover hood 4, whose outer contour is rectangular and envelops the light sources (3). The cover hood 4 is attached to an installation carrier 5, which comprises a sheet metal box and whose spacing cams 6 rest against an attachment surface 7 (e.g. a house wall) to which said installation carrier is attached with attachment elements (not illustrated), The cover hood 4 has a circumferential, light transmissive outer segment 8, which is bent to the rear from its front panel 4' and which is transparent and fluted, As evident from FIG. 1*a*, the outer segment 8 extends at right angles to the from panel 4' to the rear.

Figure 2:
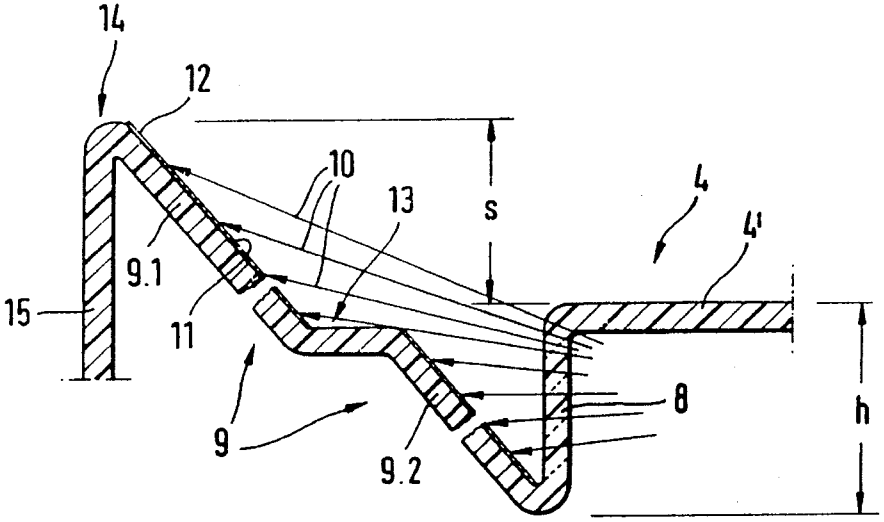
FIG. 2 is an enlarged cross-sectional view of a detail of another variation that is encircled in FIG. 1*a* with a dash-dotted line II.

Adjacent to the outer segment 8 is a reflector segment 9, which extends from the rear end of said outer segment to the front and is bent outwardly at an angle & of about 45° and which deflects to the front light 10 emitted from the light sources 3 and falling through the outer segment 8 (see FIG. 2).

The inside 9' of the reflector segment 9 is coated with a gold foil 11 (see FIG. 2) and has a height H, which is greater than the height h of the outer segment 8, so that the result is a protrusion s, which is somewhat greater than one-third of its height H and in the embodiment shown is about 4 cm.

The inside 9' of the reflector segment 8 is also designed so as to reflect light on its section protruding to the front beyond the outer segment 8 (height s), thus coated with gold foil in the present case, as is also the case in the modified embodiment according to FIG. 2, where the front outer section of the protrusion has a narrow white strip 12, which defines optically toward the front the region of darkness or shadow generated adjacent to the front end of the reflector segment.

It is not at all mandatory that the reflector segment be flat. Rather it can be concave or curved convex, as indicated with a dash-dotted line 9" in FIG. 1*a*.

In the embodiment according to FIG. 2 in agreement with FIG. 1*a* that shows the region enclosed with a dash-dotted line II in FIG. 1*a*, the reflecting segment 9 is designed as two steps, where the section 9.1 lying further to the front is offset outwardly relative to the section 9.2 lying further to the rear. In this manner another region of shadow is created in the region of bend 13.

In the embodiments according to FIGS. 1*a* and 2, the from edge 14 of the reflector segment 9 passes over into an outer segment 15, which is led to the rear and extends substantially parallel to the axis of symmetry 2 and which extends to the rear beyond the rear end of the outer segment 8.

In addition, the embodiment according to FIG. 1*a* also exhibits the feature that, at a distance from its outermost outer segment 8 a serf-contained, light transmissive inner outer segment 17 extends from the rear side 16 of the front plate 4' of the cover hood to the rear; said outer segment defines a relief-like advertising medium 18 that is offset to the rear and whose front side 18' reflects light, viz. is also coated with a gold foil, whereby the advertising medium 18 is disposed behind a transparent section 19 of the cover hood 4 or its front panel 4' that is indicated with a dashed line in FIG. 1*a*.

The electric sign advertising element 1, half of which is also reproduced as a schematic drawing in FIG. 1*b*, differs from the electric sign advertising element 1 according to FIGS. 1*a* and 2 in essence only in that the front panel 4' of the cover hood 4 is not flat, but rather arched, and that no installation carrier 5 is provided. Rather the cover hood 4 is attached with attachment elements 20 directly to the attachment surface 7. Thus it is an exception which is supposed to show merely that an electric sign advertising element of the invention can also be manufactured with or without installation carrier 5. Usually an installation carrier (with as water-tight as possible connection to the cover hood 4) is expedient in order to protect the electric sign advertising element 1 from the effects of weather.

In the electric sign advertising element 1 according to the invention, the reflector segment 9, whose inside 9' reflects light, and its protrusions over the outer segment 8 of the cover hood 4 produce during the day and especially at night, owing to the frontal shadowing effect and the continuous transition of the dark or shadow area into the regions of the reflector segment 9 that are totally irradiated by the light sources 3, a warmly glowing gold effect (and in the case of the coating with silver foil or the like the targeted silver effect), a feature that could not be obtained even approximately to date in electric sign advertising technology. In addition, other effects that are highly effective for advertising and which could not be obtained to date, can be achieved—as shown—with a multistepped design of the reflector 9 and/or a relief, which is arranged in the central part of the cover hood, is offset to the rear and belongs to the surrounding, inner outer segment.

Figure 3:
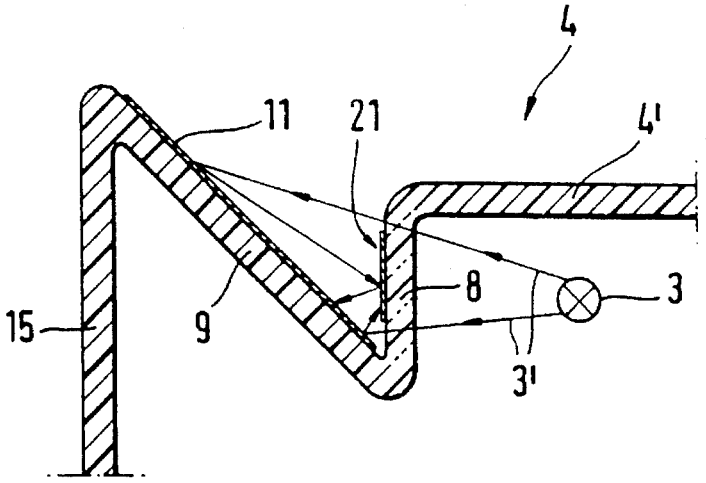
FIG. 3 is a partial outer section of the cover hood of an electric sign advertising element, where the outside of the outer segment is also coated.

FIG. 3 shows an outer section of the cover hood 4 of an electric sign advertising element 1 in a view corresponding to that of FIG. 2, where the coating 11 of the reflector segment 9 or its outside is designed as a gold or silver colored reflecting surface. In addition, the central section of the outer segment 8 with a reflecting coating 21. Since this coating 21 does not extend over the entire height of the outer segment 8, light rays 3' emitted by the light source 3 can penetrate above and below the coating 21 through the outer segment 8, fall on the reflecting coating 11 of the reflector segment 9 and be reflected by it to the coating 21, etc., so that the outside of both coatings 11, 21 are reflected in each other and produce an "infinity effect".

Figure 4:
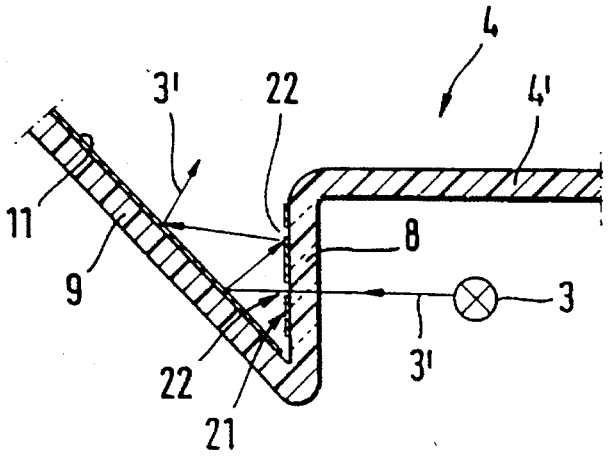
FIG. 4 is a view according to FIG. 3 of another variation.

FIG. 4 is a view according to FIG. 3 of a variation, where the coating 21 is provided with a plurality of light transmissive points 22, whereby the light transmissive points 22 are designed, generally speaking, as points, and can form a pattern, a flourish, a picture or the like, so that the picture formed by the light transmissive points 22 is reflected in the reflecting coating 11 of the reflector segment 9 and finally this picture is reproduced repeatedly with an "infinity effect" in both coatings 11, 21.

Figure 5:
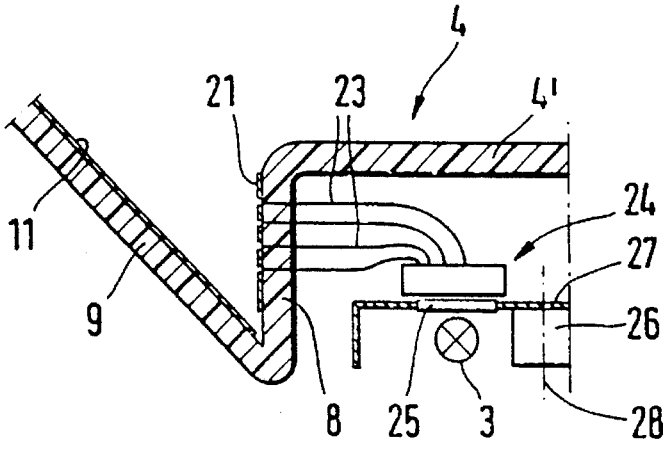
FIG. 5 is a view according to FIG. 3 of a drawing of another variation.

FIG. 5 is a view according to FIGS. 3 or 4 of another variation, where light emitted from the light source is led through glass fiber cables 23, which are guided through the outer segment 8, whereby the outer segment 8 can exhibit optionally on an outside facing the reflector segment 9 a reflecting coating 21, which is perforated at the exit points of the glass fiber cables 23. In addition, in the embodiment according to FIG. 5 there is between the light source 3 and the light inlet of the glass fiber cable 23 a filter device 24, by means of which the light emitted by the light source 3 is to be changed periodically by the filters 25. To this end, the filters 25 are arranged on a rotary disk 27, which can be rotated by a motor 26 around an axis of rotation 28, so that with suitably designed filters 25 different colored light flow alternatingly into the glass fiber cables 23 and the color of the picture formed by the ends of the glass fiber cables 23 changes periodically to match.

Figure 6:
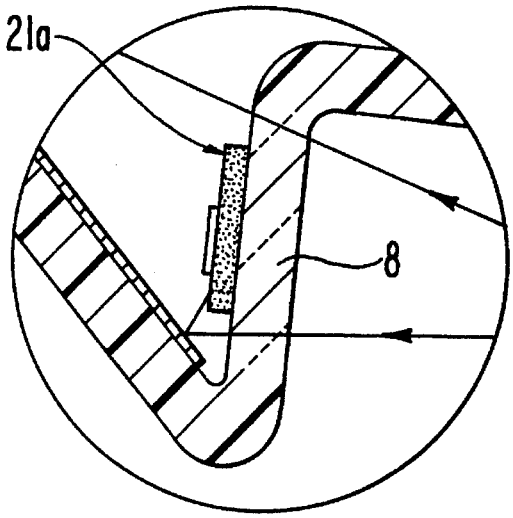
FIG. 6 is a partial enlarged view of the outer segment of FIG. 3.
Figure 7:
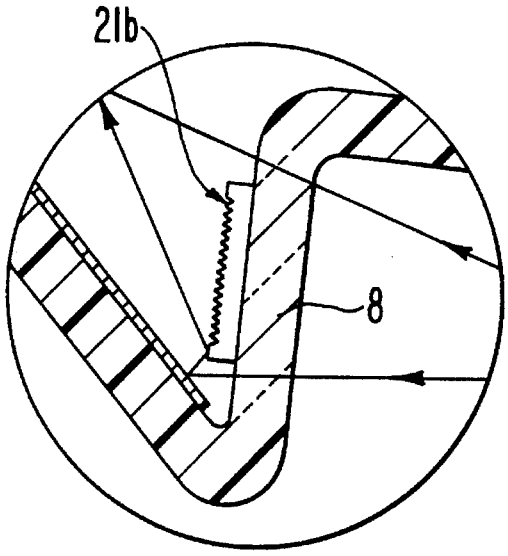
FIG. 7 is a partial enlarged view of the outer segment of FIG. 3.

With reference to FIGS. 6 and 7, it must be pointed out that the coating 21 of the outer segment 8 can also be designed as a light storage foil 21*a* or engraved foil 21*b* resulting in the effects, which have already been described above and which in turn are reflected in the coating 11 of the reflector segment.

What is claimed is:

1. Electric sign advertising element, comprising:

at least one light source, an at least partially light transmissive cover hood covering said light source, said cover hood having a front portion adapted to carry an advertising medium and further having an at least partially light transmissive outer segment, said outer segment being bent off toward the rear and extending to a rear end, a reflector segment extending from said rear end in an outward and forward direction to a front edge, said reflector segment having an inside facing said outer segment, said inside of said reflector segment reflecting light at least partially, said inside of said reflector segment reflecting light coming through said outer segment, wherein said reflector segment protrudes forward beyond said outer segment by at least about 1 inch.

2. Electric sign advertising element, as claimed in claim 1, wherein the reflector segment projects by a third of its height over the outer segment.

3. Electric sign advertising element, as claimed in claim 1, wherein the inside of the reflector segment is designed so as to reflect light also on its section protruding beyond the outer segment.

4. Electric sign advertising element, as claimed in claim 3, wherein the inside of the reflector segment is designed as a bright strip on its front outer section.

5. Electric sign advertising element, as claimed in claim 1, wherein at least one section of the inside of the reflector segment is coated with a gold foil.

6. Electric sign advertising element, as claimed in claim 1, wherein the inside of the reflector segment is coated at least section by section with a hologram foil.

7. Electric sign advertising element, as claimed in claim 1, wherein the reflector segment is designed as at least two steps, where one section lying further to the front is offset outwardly relative to another section lying further to the rear.

8. Electric sign advertising element, as claimed in claim 1, wherein the outer segment of the cover hood extends substantially parallel to the vertical axis of symmetry.

9. Electric sign advertising element as claimed in claim 1, wherein at least the inside of the reflector segment extends at about 45° relative to the vertical axis of symmetry.

10. Electric sign advertising element, as claimed in claim 1, wherein the outer segment is transparent.

11. Electric sign advertising element, as claimed in claim 10, wherein the outer segment is fluted or screened.

12. Electric sign advertising element, as claimed in claim 1, wherein the front edge of the reflector segment passes over into a rim segment which is led to the rear.

13. Electric sign advertising element, as claimed in claim 12, wherein the rim segment extends to the rear beyond the rear end of the outer segment.

14. Electric sign advertising element, as claimed in claim 1, wherein at a distance from the outermost outer segment a self-contained, light transmissive inner outer segment extends from the rear side of the cover hood to the rear; and said outer segment defines a relief-like advertising medium that is offset to the rear.

15. Electric sign advertising element, as claimed in claim 14, wherein the front side of the advertising medium reflects light.

16. Electric sign advertising element, as claimed in claim 14, wherein the advertising medium is disposed behind a transparent section of the cover hood.

17. Electric sign advertising element, as claimed in claim 1, wherein the outside of the coating of the reflector segment is designed as a gold colored reflecting surface, and wherein at least one section of the side of the outer segment facing the reflector segment is provided with a reflecting coating.

18. Electric sign advertising element, as claimed in claim 17, wherein the central section of the side of the outer segment facing the reflector segment is reflective.

19. Electric sign advertising element, as claimed in claim 17, wherein the reflecting coating of the outer segment is provided with at least one light transmissive point.

20. Electric sign advertising element, as claimed in claim 19, wherein the reflecting coating of the outer segment is provided with a plurality of especially small, cruciform, light transmissive points.

21. Electric sign advertising element, as claimed in claim 17, wherein the coating of the reflector segment and the coating of the outer segment are designed the same.

22. Electric sign advertising element, as claimed in claim 17, wherein the coating of the reflector segment and the coating of the outer segment are designed differently.

23. Electric sign advertising element, as claimed in claim 1, wherein a plurality of glass fiber cables are guided to the outer segment from the light source.

24. Electric sign advertising element, as claimed in claim 23, wherein the ends of the glass fiber cables are guided through the outer segment.

25. Electric sign advertising element, as claimed in claim 23, wherein the glass fiber cables are to be fed alternatingly with different colored light.

26. Electric sign advertising element, as claimed in claim 25, wherein there is between the light source and the light inlet of the glass fiber cable a device, by means of which the light emitted by the light source is to be changed periodically by filters, which are arranged on a rotary disk, which is driven by a motor.

27. Electric sign advertising element, as claimed in claim 1, wherein at least one section of the side of the outer segment that faces the reflector segment is coated with a light storage foil, which still emits light after the light source(s) have been turned off.

28. Electric sign advertising element, as claimed in claim 27, wherein the light storage foil is provided with passive storing sections/imprints.

29. Electric sign advertising element, as claimed in claim 1, wherein at least one section of the side of the outer segment that faces the reflector segment is provided with an engraved foil, whose outside is provided with a plurality of engraved lines extending optionally in different directions.

30. Electric sign advertising element, as claimed in claim 1, wherein at least one section of the inside of the reflector segment is coated with a silver foil.

31. Electric sign advertising element, as claimed in claim 1, wherein the outside of the coating of the reflector segment is designed as a silver colored reflecting surface, and wherein at least one section of the side of the outer segment facing the reflector segment is provided with a reflecting coating.

* * * * *